US005692604A

United States Patent [19]

Houk

[11] Patent Number: 5,692,604

[45] Date of Patent: Dec. 2, 1997

[54] DAILY WEAR ORGANIZER

[76] Inventor: Reba Houk, 2816 Haynes Dr., Midland, Tex. 79705

[21] Appl. No.: 513,460

[22] Filed: Aug. 11, 1995

[51] Int. Cl.[6] ..... B65D 85/18

[52] U.S. Cl. ..... 206/278; 190/111

[58] Field of Search ..... 206/287, 287.1, 206/278; 190/109, 111; 223/87, 89; 211/34, 38, 70.1, 72, 113

[56] References Cited

U.S. PATENT DOCUMENTS

| | | | |
|---|---|---|---|
| 4,189,036 | 2/1980 | Pelavin | 206/278 |
| 4,195,739 | 4/1980 | Sweet, III | 211/70.1 X |
| 4,327,836 | 5/1982 | Okuno | 211/113 X |
| 4,585,127 | 4/1986 | Benedict | 211/34 |
| 4,947,987 | 8/1990 | Keenan | 206/278 X |
| 5,137,149 | 8/1992 | Polacek | 223/87 X |
| 5,248,036 | 9/1993 | Radocha, Sr. et al. | 211/72 X |
| 5,533,534 | 7/1996 | Cariello et al. | 211/34 X |

*Primary Examiner*—Allan N. Shoap
*Assistant Examiner*—Christopher J. McDonald
*Attorney, Agent, or Firm*—Michael I. Kroll

[57] ABSTRACT

A daily wear organizer (10) comprising an elongated flexible flat substratum (12). A structure (14) is for connecting the flexible flat substratum (12) to a stationary object (14), so that the flexible flat substratum (12) can hang vertically therefrom. A plurality of flexible panels (16) are vertically spaced apart and affixed to the flexible flat substratum (12), so as to form multiple pockets for storing various articles therein.

20 Claims, 3 Drawing Sheets

DAILY WEAR ORGANIZER

BACKGROUND OF THE INVENTION

1. Field of the Invention

The instant invention relates generally to storage devices and more specifically it relates to a daily wear organizer.

2. Description of the Prior Art

Numerous storage devices have been provided in prior art. For example, U.S. Pat. Nos. 3,139,133 to Spector; 3,294,134 to Matross et al.; 5,209,344 to Smith and 5,295,587 to Downes et al. all are illustrative of such prior art. While these units may be suitable for the particular purpose to which they address, they would not be as suitable for the purposes of the present invention as heretofore described.

SPECTOR, LENORE

TRAVEL VANITY CONTAINER OR HOLDER

U.S. Pat. No. 3,139,133

A holder or container for articles of various sizes, comprising a long rectangular fabric sheet defining a back. A plurality of flexible plastic bands are provided. Each of the bands are longer than the width of the sheet. Opposite ends of the bands are secured to opposite lateral edges of one side of the sheet, so that the bands bulge outwardly of the sheet. At least some of the bands having longitudinal stitching spaced transversely of the lateral edges of the sheet to define multiple compartments bulging outwardly of the sheet. Lines of stitching extend transversely across the sheet between opposite top and bottom edges of the bands. The bottom marginal portion of each band and the top marginal portion of the next lower band cooperate to form a plurality of the compartments. The bands are formed of transparent material so that contents of the compartments are visible. An auxiliary bag is detachably secured to the other side of the sheet. The bag has an openable closure providing access to the interior of the bag. A gusseted pocket is on the exterior of the bag. The pocket has a zipper closure.

MATROSS, IRVING B.

MATROSS, SAMUEL

WARDROBE BAG

U.S. Pat. No. 3,294,134

In an elongated wardrobe bag of the type formed of flexible web material, providing a multiplicity of vertically spaced apart compartments accessible from a vertical edge of the bag. The bag has means adapted to support the bag. The improvement is wherein the bag comprises the combination of two outer side wall members of flexible web material each extending along the length of the bag. An inner side wall member extends at least along a portion of the length of the outer side wall members. The inner side wall member has a running length substantially longer than the corresponding running length of the outer side wall members. The inner side wall member is configured into a multiplicity of vertically spaced apart special loops. The inner side wall member is secured to the outer side wall members alternatively between the loops by transversely extending joints. The inner side wall member at least extends freely from a first transverse joint with one of the outer side wall members, downwardly a first distance, thence, upwardly a second distance substantially greater than the first distance to a second transverse joint with the other of the outer side wall members, thence freely downwardly a third distance less than the second distance, thence upwardly a fourth distance substantially greater than the third distance to a third transverse joint. The running length of the inner side wall from the first to the third joints and the length of the outer side wall between the first and third joints define a first compartment. The portion of the inner side wall member extends between the second and third transverse joints forming the bottom of the next above compartment. The compartments are caused to vertically overlap due to the relationship of the third and fourth distances.

SMITH, DOROTHY A.

DEVICE FOR ARRANGING AND STORING JEWELRY

U.S. Pat. No. 5,209,344

A collapsible foldable jewelry organizer and storage device capable of being hung from a closet rod or protrusion, which renders the jewelry objects stored thereby individually visible to the user, is disclosed. The device comprises a flexible substratum having a plurality of flexible transparent or translucent pockets within which jewelry objects may be arranged in a matrix configuration. The substratum is supported from the bottom edge of a hanger by means of the interaction of the bottom edge of the hanger with a tube extending around the bottom edge of the hanger. The tube is attached to the substratum along the top edge of the substratum allowing the device to be hung from a closet rod or similar protrusion.

DOWNES, GLENN W.

DOWNES, PEGGY W.

EARRING AND BROOCH ORGANIZER

U.S. Pat. No. 5,295,587

Herein described is a device for organizing earrings and brooches. The device differs from conventional jewelry boxes in that it provides a greater surface area over which to spread the stored jewelry items. The device comprises a strip of fabric folded to form a front layer and a rear layer, at least one strip of eyelet lace joined to the fabric. A means is for suspending the organizing device onto another object. The stems of earrings pierce either the front layer or rear layer of fabric, and the backs are attached in between the layers. In the event that the backs of the earrings fall, a closed bottom fold between the layers of fabric catches the backs and thereby prevents them from being lost. Earrings with clips or wire hoops are readily attached to the strip or strips of eyelet lace. In the preferred embodiment, a vinyl hanger serves as the means for suspending the device onto another object.

SUMMARY OF THE INVENTION

A primary object of the present invention is to provide a daily wear organizer that will overcome the shortcomings of the prior art devices.

Another object is to provide a daily wear organizer which will store various items that coordinate with and complete a garment outfit selected to be worn on a given day.

An additional object is to provide a daily wear organizer that can hang on a closet pole, closet hook or clothes hanger and have a plurality of vertical pockets to hold the various items therein, so that a person will have the convenience of being able to plan and organize what to wear in advance to save time when getting dressed.

A further object is to provide a daily wear organizer that is simple and easy to use.

A still further object is to provide a daily wear organizer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
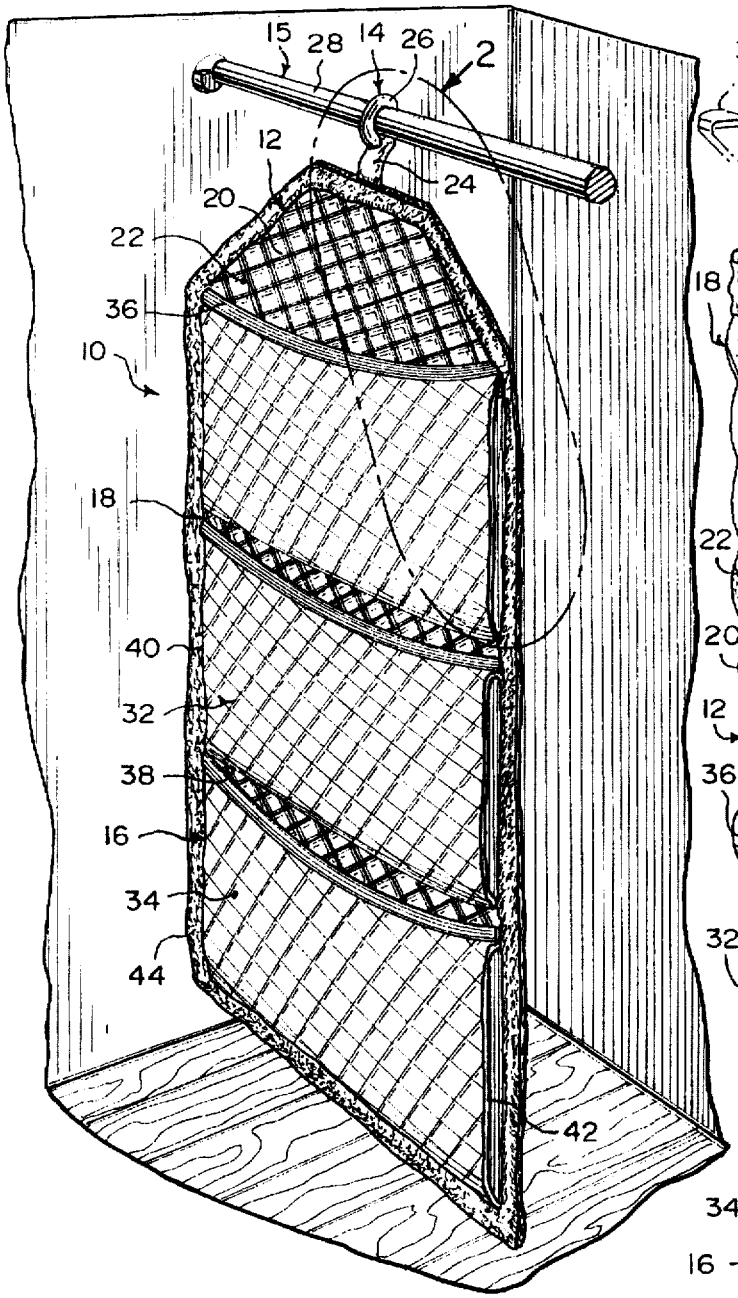
FIG. 1 is a perspective view of a first embodiment of the instant invention hanging in a clothes closet.
Figure 2:
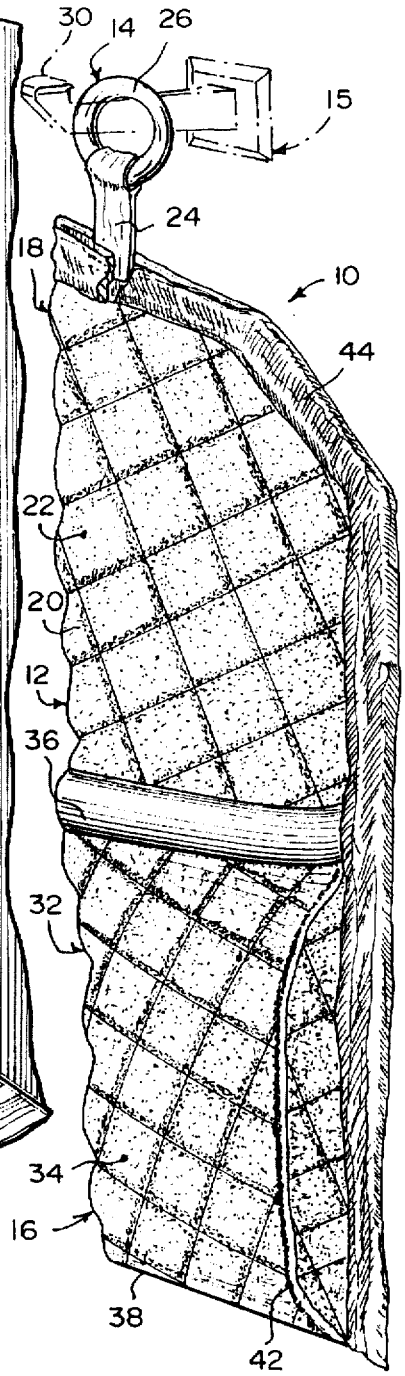
FIG. 2 is an enlarged perspective view of a portion thereof as indicated by arrow 2 in FIG. 1, hanging on a closet hook shown in phantom.

Turning now descriptively to the drawings, in which similar reference characters denote similar elements throughout the several views, FIGS. 1 and 2 illustrate a daily wear organizer 10 comprising an elongated flexible flat substratum 12. A structure 14 is for connecting the flexible flat substratum 12 to a stationary object 15, so that the flexible flat substratum 12 can hang vertically therefrom. A plurality of flexible panels 16 are vertically spaced apart and affixed to the flexible flat substratum 12, so as to form multiple pockets for storing various articles therein.

The flexible flat substratum 12 in FIGS. 1 and 2, is a generally rectangular sheet 18 having a tapered top end 20. The flexible flat substratum 12 is fabricated out of opaque quilted material 22.

The connecting structure 14 consists of a short piece of webbing 24 extending upwardly from the center of the tapered top end 20 of the flexible flat substratum 12. A ring 26 is attached to a distal free end of the short piece of webbing 24. The ring 26 can engage with the stationary object 15 being a closet pole 28 in FIG. 1, a closet hook 30 shown in phantom in FIG. 2, a clothes hanger (not shown) and similar articles.

Each flexible panel 16 is a rectangular sheet 32 having a length approximate to the width of the flexible flat substratum 12. Each flexible panel 16 is fabricated out of opaque quilted material 34.

Each flexible panel 16 is affixed along a top edge 36, a bottom edge 38 and a first side edge 40 to the flexible flat substratum 12, so that each pocket is formed with a second open side edge 42 for gaining access into the pocket. Trimming 44 extends about the perimeter of the flexible flat substratum 12, so as to finish off the edges thereabout.

FIGS. 3 through 6 illustrate a modified daily wear organizer 46 comprising an elongated flexible flat substratum 48. A structure 62 is for connecting the flexible flat substratum 48 to the stationary object 15, shown in FIGS. 1 and 2, so that the flexible flat substratum 48 can hang vertically therefrom. A plurality of flexible panels 68 are vertically spaced apart and affixed to the flexible flat substratum 48, so as to form multiple pockets for storing various articles therein.

The flexible flat substratum 48 includes a first sheet 50 being generally rectangular having a tapered top end 52. A second sheet 54 being generally rectangular has a tapered top end 56. The second sheet 54 is of the same size and shape as the first sheet 50. A facility 58 is for securing the first sheet 50 and the second sheet 54 together at spaced apart intervals, so as to form additional pockets with open side edges therebetween. The first sheet 50 and the second sheet 54 are fabricated out of a thin plastic material 60.

The connecting structure 62 includes a short piece of webbing 64 extending upwardly from the center between the tapered top ends 52, 56 of the first sheet 50 and the second sheet 54 of the flexible flat substratum 48. A ring 66 is attached to a distal free end of the short piece of webbing 64. The ring 66 can engage with the stationary object 15 being the closet pole 28 in FIG. 1, the closet hook 30 in FIG. 2, the clothes hanger that is not shown, and similar articles.

Figure 3:
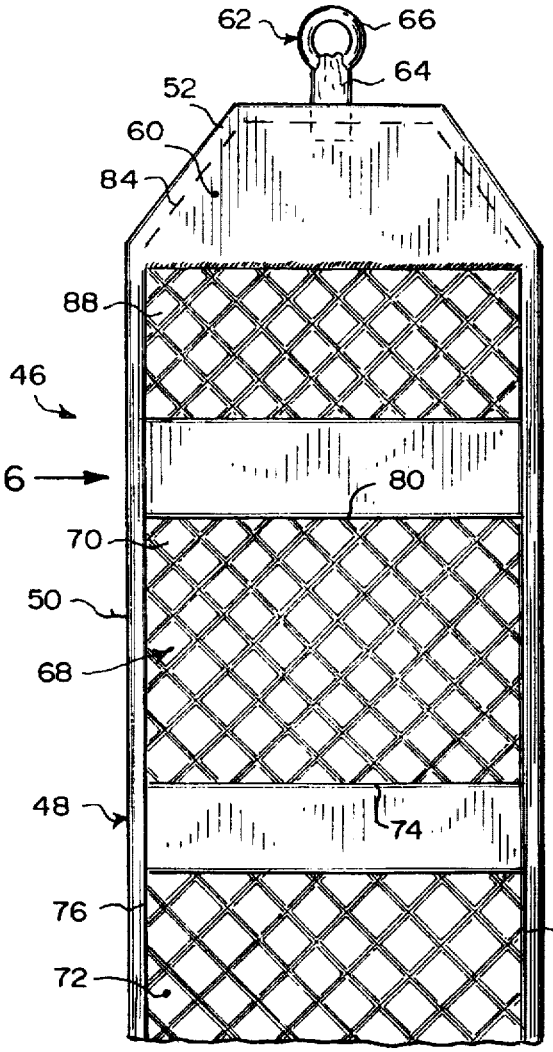
FIG. 3 is a front view of a second embodiment of the instant invention with parts broken away.
Figure 5:
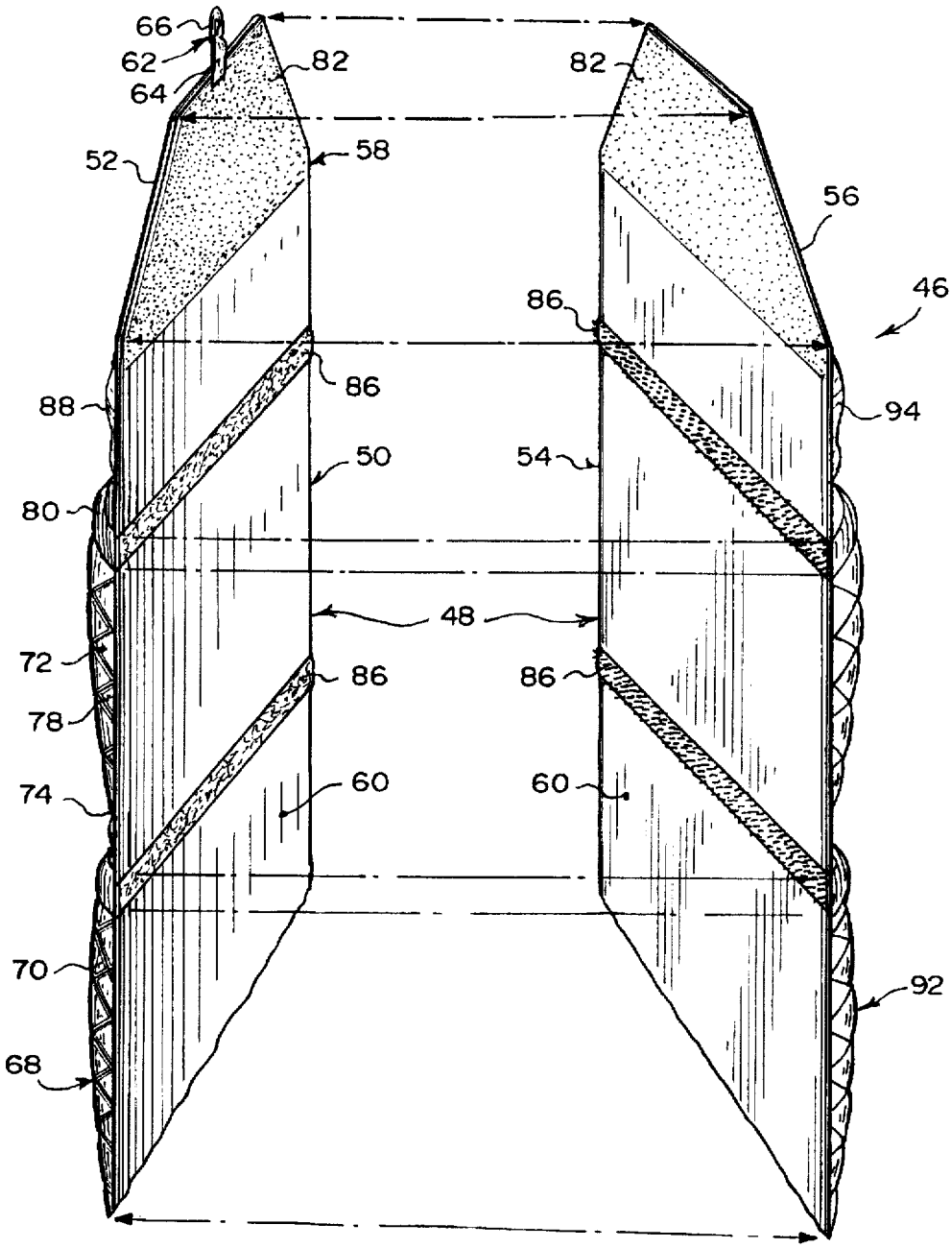
FIG. 5 is an exploded perspective view with parts broken away, showing the first and second sheets of the flexible flat substratum separated.
Figure 6:
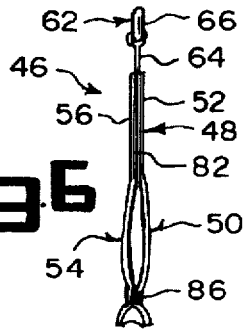
FIG. 6 is a diagrammatic side view with parts broken away taken in the direction of arrow 6 in FIG. 3, showing the formation of the side open pockets therein.

The flexible panel 68 is a rectangular sheet 70, having a length approximate to the width of the first sheet 50 and the second sheet 54 of the flexible flat substratum 48. The flexible panel 68 can be fabricated out of opaque quilted material 72, as shown in FIGS. 3 and 5. The flexible panel 68 is affixed along a bottom edge 74 and the side edges 76, 78 to a front surface of the first sheet 50 of the flexible flat substratum 48, so that each pocket is formed with an open top edge 80 for gaining access into the pocket.

The securing facility 58 includes adhesive 82 applied to mating rear surfaces on the tapered top ends 52, 56 of the first sheet 50 and the second sheet 54 of the flexible flat substratum 48. Stitching 84 is along the perimeter of the tapered top ends 52 and 56 of the first sheet 50 and the second sheet 54 of the flexible flat substratum 48. A plurality of VELCRO strips 86 are vertically spaced apart on mating rear surfaces of the first sheet 50 and the second sheet 54 of the flexible flat substratum 48.

Figure 3A:
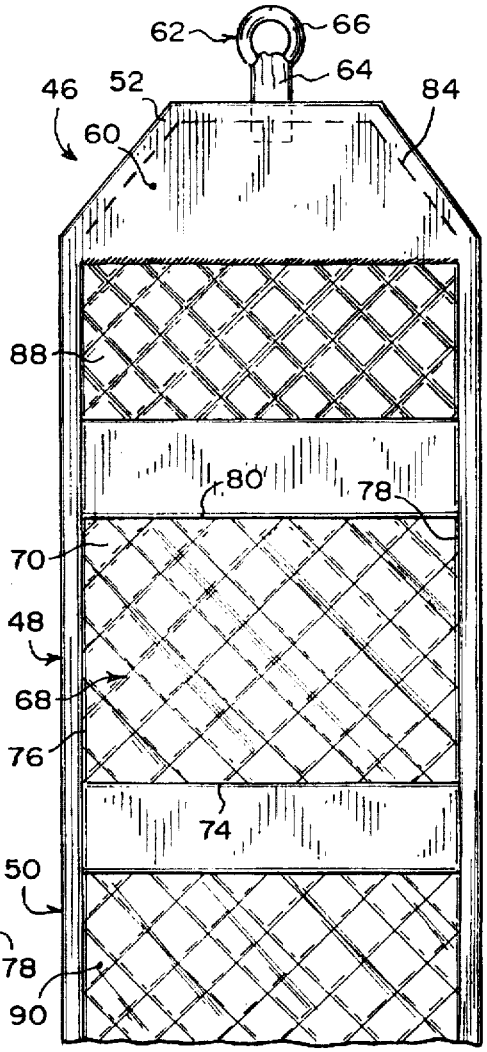
FIG. 3A is a front view similar to FIG. 3, showing the pockets made of transparent quilted material instead of opaque quilted material.
Figure 4:
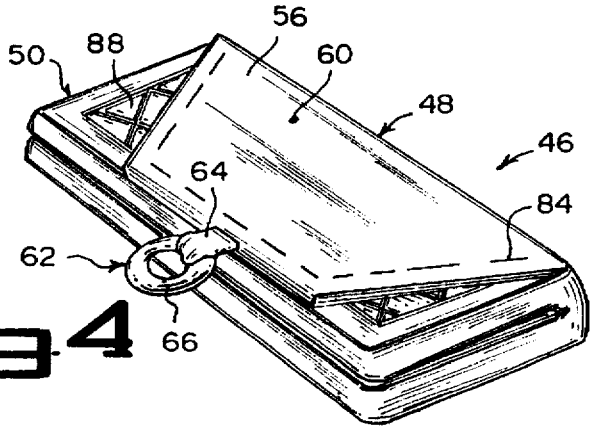
FIG. 4 is a perspective view of the second embodiment folded up for storage.

A decorative opaque quilted rectangular shaped flat piece 88 is affixed about its edges to the front surface of the first sheet 50 directly below the tapered top end 52. As shown in FIG. 3A, each flexible panel 68 can also be fabricated out of transparent quilted material 90.

A plurality of auxiliary flexible panels 92, as shown in FIG. 5, are vertically spaced apart and affixed to a front surface of the second sheet 54, so as to form multiple auxiliary pockets for storing various additional articles therein. The auxiliary flexible panels 92 are identical to the flexible panels 68 on the front surface of the first sheet 50. An additional decorative opaque quilted rectangular shaped flat piece 94 is affixed about its edges to the front surface of the second sheet 54, directly below the tapered top end 56.

The flexible panels 92 on the front surface of the first sheet 50 could be made out of transparent plastic material. The flexible panels 94 on the front surface of the second sheet 54 could be made of either all transparent plastic material, all opaque plastic material or a combination of transparent and opaque plastic material. If the plastic used is a fairly thin grade, the transparent plastic could be quilted with machine stitching to make the thinner pieces of plastic thicker and more durable, but mainly for the decorative effect of colored stitching against a white background material.

The stitching 84 along the perimeter of the tapered top ends 52 and 56 may be inside, outside or both. The top part of the first sheet 50 and the second sheet 54 are plain, so that monogramming or heat transfers may be applied.

The daily wear organizers 10 and 46 can be marketable in many different ways, such as a souvenir, a small appreciation award or as an item available in college book stores. A removable, hinged ring would make it possible for a purchaser to have the product personalized after buying it, that would help to increase sales.

LIST OF REFERENCE NUMBERS

10 daily wear organizer
12 flexible flat substratum of 10
14 connecting structure of 10
15 stationary object
16 flexible panel of 10
18 generally rectangular sheet for 12
20 tapered top end of 18
22 opaque quilted material of 12
24 short piece of webbing of 14
26 ring of 14
28 closet pole for 15
30 closet hook for 15
32 rectangular sheet for 16
34 opaque quilted material of 16
36 top edge of 16
38 bottom edge of 16
40 first side edge of 16
42 second open side edge of 16
44 trimming about 12
46 modified daily wear organizer
48 flexible flat substratum of 46
50 first sheet of 48
52 tapered top end of 50
54 second sheet of 48
56 tapered top end of 54
58 securing facility
60 thin plastic material of 50 and 54
62 connecting structure of 46
64 short piece of webbing of 62
66 ring of 62
68 flexible panel on 50
70 rectangular sheet for 68
72 opaque quilted material of 68
74 bottom edge of 68
76 first side edge of 68
78 second side edge of 68
80 open top edge of 68
82 adhesive of 58
84 stitching of 58
86 VELCRO strip of 58
88 decorative opaque quilted rectangular shaped piece on 50
90 transparent quilted material of 68
92 auxiliary flexible panel on 54
94 additional decorative opaque quilted rectangular shaped piece on 54

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A daily wear organizer comprising:

i) an elongated flexible flat substratum including:

a) a first sheet generally rectangular having a tapered top end;

b) a second sheet generally rectangular having a tapered top end, in which said second sheet is of the same size and shape as said first sheet; and c) means for securing said first sheet and said second sheet together at spaced apart intervals, so as to form pockets with open side edges therebetween;

ii) means for connecting said flexible flat substratum to a stationary object, so that said flexible flat substratum can hang vertically therefrom; and iii) a plurality of flexible panels vertically spaced apart and affixed to said flexible flat substratum, so as to form multiple pockets for storing various articles therein.

2. A daily wear organizer as recited in claim 1, wherein said first sheet and said second sheet are fabricated out of thin plastic material.

3. A daily wear organizer as recited in claim 1, wherein said connecting means includes:

a) a short piece of webbing extending upwardly from the center between the tapered top ends of said first sheet and said second sheet of said flexible flat substratum; and b) a ring attached to a distal free end of said short piece of webbing, so that said ring can engage with a stationary object being a closet pole, a closet hook, a clothes hanger and similar articles.

4. A daily wear organizer as recited in claim 1, wherein said flexible panel is a rectangular sheet having a length approximate to the width of said first sheet and said second sheet of said flexible flat substratum.

5. A daily wear organizer as recited in claim 1, wherein each said flexible panel is fabricated out of opaque quilted material.

6. A daily wear organizer as recited in claim 1, wherein each said flexible panel is affixed along a bottom edge and the side edges to a front surface of said first sheet of said flexible flat substratum, so that each pocket is formed with an open top edge for gaining access into the pocket.

7. A daily wear organizer as recited in claim 1, wherein said securing means includes:

a) adhesive applied to mating rear surfaces on said tapered top ends of said first sheet and said second sheet of said flexible flat substratum;

b) stitching along the perimeter of said tapered top ends of said first sheet and said second sheet of said flexible flat substratum; and c) a plurality of hook and loop type fastener strips vertically spaced apart on mating rear surfaces of said first sheet and said second sheet of said flexible flat substratum.

8. A daily wear organizer as recited in claim 1, further including a decorative opaque quilted rectangular shaped flat piece affixed about its edges to the front surface of said first sheet directly below said tapered top end.

9. A daily wear organizer as recited in claim 1, wherein each said flexible panel is fabricated out of transparent quilted material.

10. A daily wear organizer as recited in claim 1, further including a plurality of auxiliary flexible panels vertically spaced apart and affixed to a front surface of said second sheet, so as to form multiple auxiliary pockets for storing various additional articles therein, said auxiliary flexible panels being identical to said flexible panels on the front surface of said first sheet.

11. A daily wear organizer as recited in claim 1, further including an additional decorative opaque quilted rectangular shaped flat piece affixed about its edges to the front surface of said second sheet directly below said tapered top end.

12. A daily wear organizer as recited in claim 2, wherein said connecting means includes:

a) a short piece of webbing extending upwardly from the center between the tapered top ends of said first sheet and said second sheet of said flexible flat substratum; and b) a ring attached to a distal free end of said short piece of webbing, so that said ring can engage with a stationary object being a closet pole, a closet hook, a clothes hanger and similar articles.

13. A daily wear organizer as recited in claim 12, wherein said flexible panel is a rectangular sheet having a length approximate to the width of said first sheet and said second sheet of said flexible flat substratum.

14. A daily wear organizer as recited in claim 13, wherein each said flexible panel is fabricated out of opaque quilted material.

15. A daily wear organizer as recited in claim 14, wherein each said flexible panel is affixed along a bottom edge and the side edges to a front surface of said first sheet of said flexible flat substratum, so that each pocket is formed with an open top edge for gaining access into the pocket.

16. A daily wear organizer as recited in claim 15, wherein said securing means includes:

a) adhesive applied to mating rear surfaces on said tapered top ends of said first sheet and said second sheet of said flexible flat substratum;

b) stitching along the perimeter of said tapered top ends of said first sheet and said second sheet of said flexible flat substratum; and c) a plurality of hook and loop type fastener strips vertically spaced apart on mating rear surfaces of said first sheet and said second sheet of said flexible flat substratum.

17. A daily wear organizer as recited in claim 16, further including a decorative opaque quilted rectangular shaped flat piece affixed about its edges to the front surface of said first sheet directly below said tapered top end.

18. A daily wear organizer as recited in claim 17, wherein each said flexible panel is fabricated out of transparent quilted material.

19. A daily wear organizer as recited in claim 18, further including a plurality of auxiliary flexible panels vertically spaced apart and affixed to a front surface of said second sheet, so as to form multiple auxiliary pockets for storing various additional articles therein, said auxiliary flexible panels being identical to said flexible panels on the front surface of said first sheet.

20. A daily wear organizer as recited in claim 19, further including an additional decorative opaque quilted rectangular shaped flat piece affixed about its edges to the front surface of said second sheet directly below said tapered top end.

* * * * *